US005282540A

United States Patent [19]

Beck

[11] Patent Number: 5,282,540

[45] Date of Patent: Feb. 1, 1994

[54] TAMPER BAND WITH FLEXIBLE ENGAGEMENT MEMBER

[75] Inventor: James M. Beck, Carol Stream, Ill.

[73] Assignee: Creative Packaging Corp., Wheeling, Ill.

[21] Appl. No.: 980,623

[22] Filed: Nov. 23, 1992

[51] Int. Cl.[5] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| Re. 33,265 | 7/1990 | Gregory et al. | 215/252 |
| 4,470,513 | 9/1984 | Ostrowsky | 215/252 |
| 4,478,343 | 10/1984 | Ostrowsky | 215/252 |
| 4,550,844 | 11/1985 | Lininger | 215/252 |
| 4,700,859 | 10/1987 | Gregory | 215/252 |
| 4,721,218 | 1/1988 | Gregory et al. | 215/252 |
| 4,753,360 | 6/1988 | Baxter | 215/252 |
| 4,784,280 | 11/1988 | Breuer et al. | 215/252 |
| 4,801,031 | 1/1989 | Barriac | 215/252 |
| 5,004,112 | 4/1991 | McBride | 215/252 |
| 5,096,079 | 3/1992 | Odet | 215/252 |

*Primary Examiner*—Allan N. Shoap
*Assistant Examiner*—Nova Stucker
*Attorney, Agent, or Firm*—Silverman, Cass & Singer, Ltd.

[57] ABSTRACT

A tamper evident closure for a container opening including a substantially cylindrical end cap closed at a first end by a top surface, open at a second opposite end and including an annular side wall having a predetermined width extending between the first and second ends, a tamper band member frangibly connected about the second opposite end of the end cap for detaching from the end cap and remaining affixed to the container upon removal of the end cap from the container, an engagement member integrally formed with a first portion of an inside surface of the tamper band for providing gripping contact between the tamper band and a substantially cylindrical or rectilinear neck portion of the container, for restricting axial movement of the tamper band with respect to the end cap and the neck portion and for preventing removal of the tamper band from the container upon severing of the frangible connection and removal of the end cap, and stop members integrally formed with a second portion of, and at a plurality of predetermined positions about, the inside surface of the tamper band for reinforcing the engagement member during contact with the rectilinear neck portion of the container.

8 Claims, 3 Drawing Sheets

Fig. 3
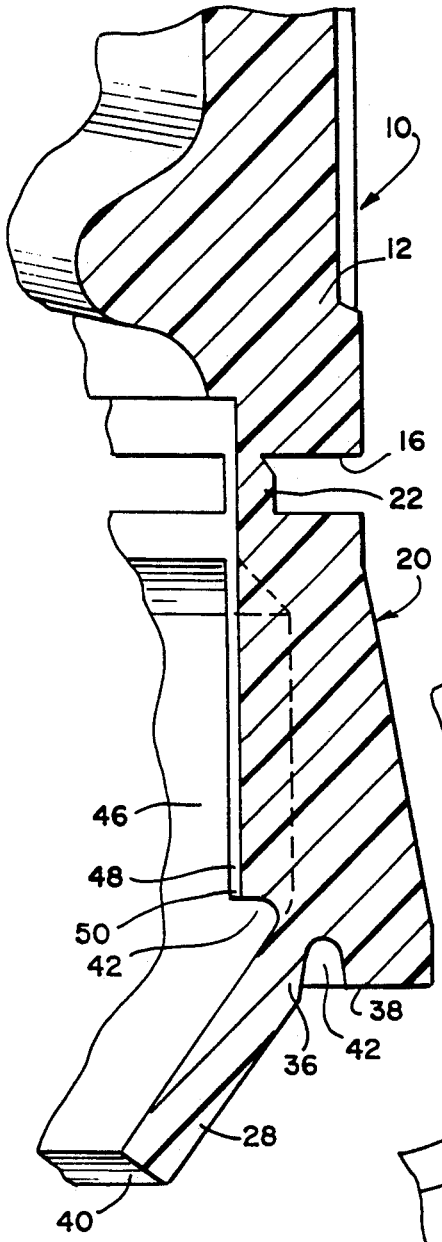
Fig. 4
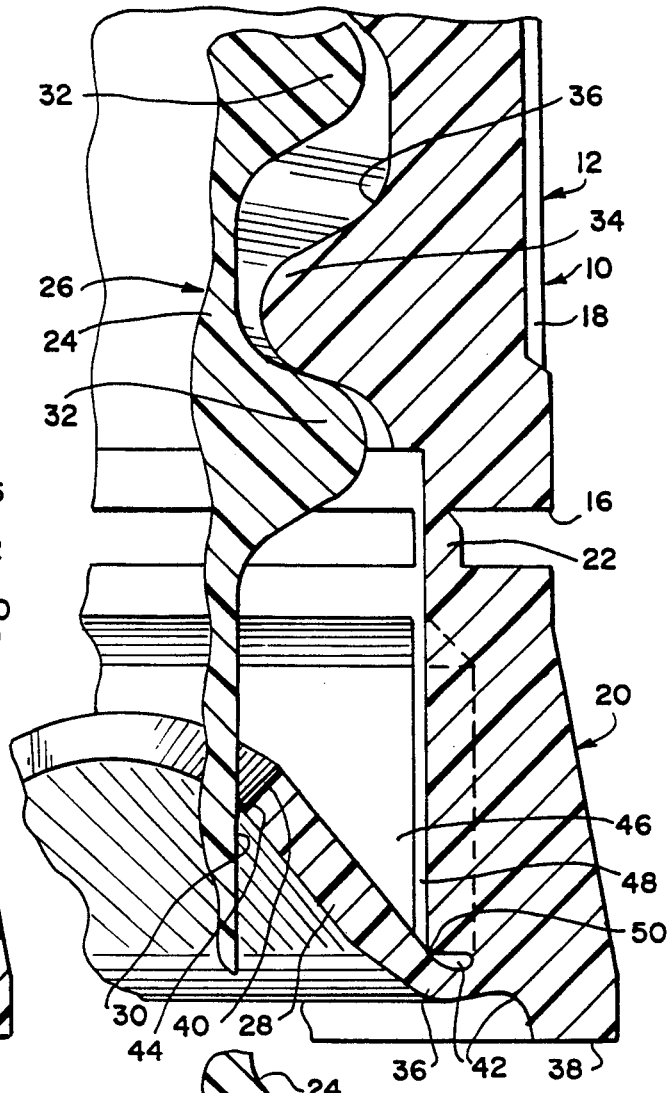
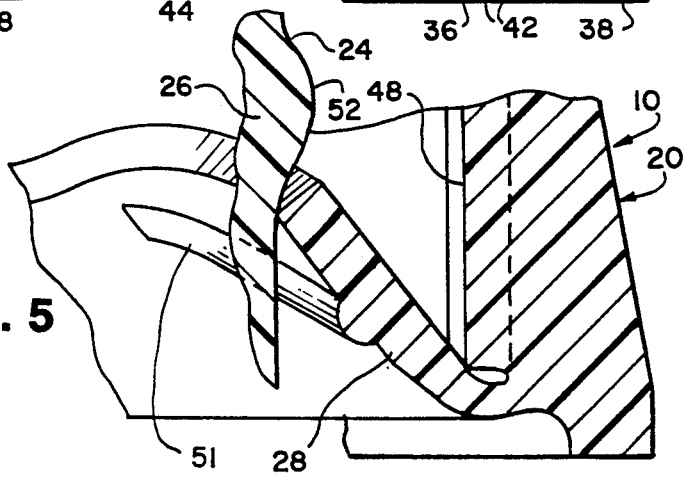
Fig. 5

TAMPER BAND WITH FLEXIBLE ENGAGEMENT MEMBER

BACKGROUND OF THE INVENTION

1. Field of the Invention

This invention relates generally to tamper bands for container end caps, and more particularly to a tamper band having an engagement member on its interior surface which is flexible and provides gripping of a substantially cylindrical or rectilinear portion of the container neck during removal of the end cap to restrict axial movement of the tamper band, enable severing of a frangible connection between the tamper band and the end cap and retain the tamper band on the container after removal of the end cap to provide evidence of tampering.

2. Description of the Related Art

In order to sever a frangible connection between a tamper band and an end cap affixed to a container neck, axial movement of the tamper band with respect to the end cap must be restricted as the end cap is removed. To restrict such axial movement, the container neck typically requires modification to include a tamper band engagement flange about its periphery which abuts the tamper band during removal of the end cap.

Examples of such tamper bands are illustrated in U.S. Pat. Nos. 4,470,513 and 4,478,343 each of which discloses a tamper-indicating closure having an annular lower portion which includes a plurality of spaced apart tabs connected by way of flexible webs and having a projection on each tab. The container includes a neck portion having an annular flange below the threads on the neck including an upper annular surface which is sloped downwardly to meet an essentially horizontal lower annular surface. During removal of the closure, the projections of the tabs interfere with the horizontal lower annular surface of the annular flange to prevent removal of the tamper band and provide severing of the frangible connection. To ensure that the tabs of the annular lower portion make good interfering contact with the annular container flange, the closure can be modified to vary the positioning of the annular lower portion with respect to the annular upper portion of the tamper band or by providing projections on the tabs and/or on the lower inside part of the annular upper portion of the tamper band.

It therefore is desirable to provide a tamper band having an engagement member on its interior surface which engages a substantially cylindrical or rectilinear portion of the container neck to restrict axial movement of the tamper band, enable severing of the frangible connection between the tamper band and the end cap and retain the tamper band on the container neck to provide visible indication of tampering to a user after the end cap is removed.

SUMMARY OF THE INVENTION

The invention provides a tamper evident closure for a container opening having a substantially cylindrical end cap closed at a first end by a top surface, open at a second opposite end and including an annular side wall having a predetermined width extending between the first and second ends. A tamper band member frangibly is connected about the second opposite end of the end cap for detaching from the end cap and remaining affixed to the container upon removal of the end cap from the container. An engagement member integrally is formed with a first portion of an inside surface of the tamper band for providing gripping contact between the tamper band and a substantially cylindrical or rectilinear neck portion of the container, for restricting axial movement of the tamper band with respect to the end cap and the neck portion and for preventing removal of the tamper band from the container upon severing of the frangible connection and removal of the end cap. Stop members also integrally are formed with a second portion of, and at a plurality of predetermined positions about, the inside surface of the tamper band for reinforcing the engagement member during gripping contact with the rectilinear neck portion of the container.

BRIEF DESCRIPTION OF THE DRAWINGS

FIG. 3 is an enlarged partial vertical cross-sectional view of the closure of the invention taken along line 3—3 of FIG. 1 and in the direction indicated generally illustrating the engagement member of the tamper band and a stop member formed on the inside surface of the tamper band;

FIG. 4 is an enlarged partial vertical cross-sectional view of the closure of the invention, similar to FIG. 3, illustrating the closure applied to a container neck and the gripping of the engagement member with a substantially cylindrical or rectilinear portion of the container neck;

FIG. 5 is an enlarged partial vertical cross-sectional view of the closure and container neck illustrating another embodiment of the engagement member of the tamper band;

DESCRIPTION OF THE PREFERRED EMBODIMENTS

Figure 1:
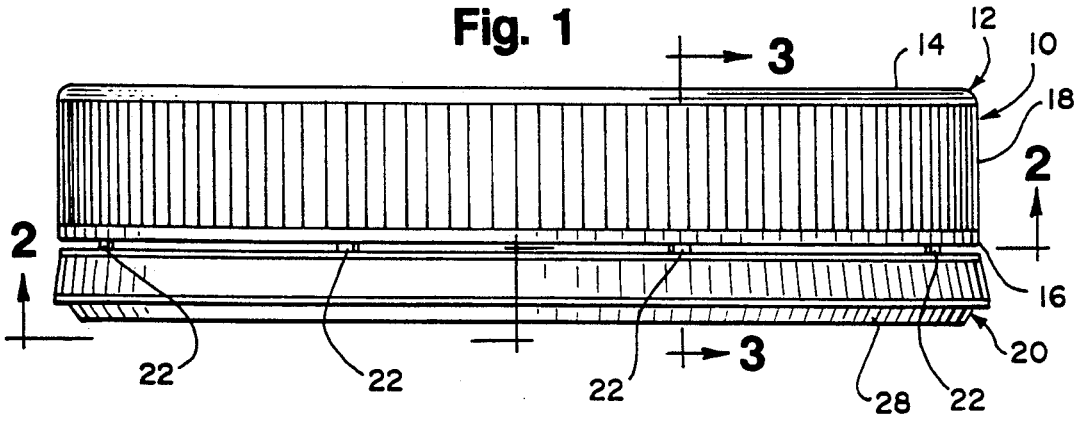
FIG. 1 is a front elevational view of the closure of the invention before being attached to a container illustrating the end cap, tamper band and the frangible connection therebetween as well as a portion of the engagement member of the tamper band.
Figure 2:
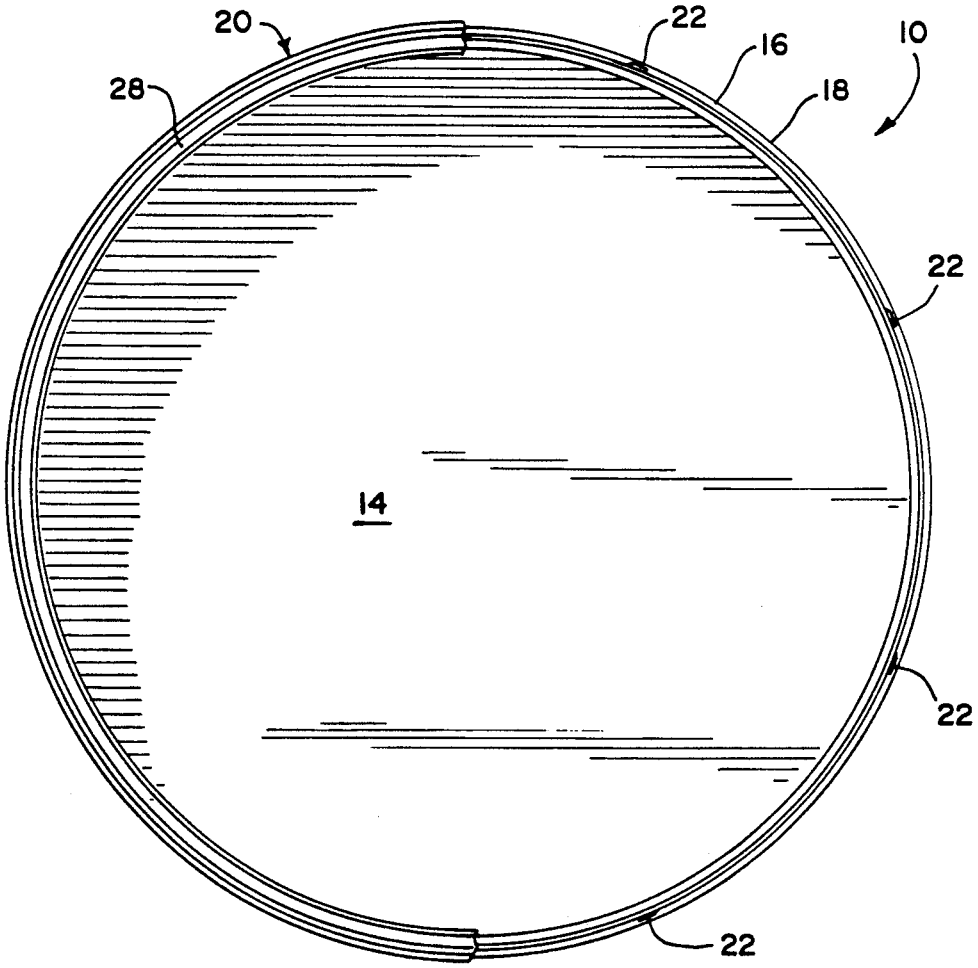
FIG. 2 is a bottom plan view in partial section of the closure of the invention taken along line 2—2 of FIG. 1 and in the direction indicated generally illustrating the engagement member of the tamper band and the frangible connections with the end cap.

As FIG. 1 illustrates, the closure of the invention generally is designated by the reference numeral 10. The closure 10 is of a one-piece design and includes an annular end cap 12 having a first closed end 14, a second opposite open end 16 and an annular side wall 18 interconnecting the first and second ends 14 and 16.

To provide an indication that the closure 10 and/or contents of a container may have been tampered with, a tamper indicating band 20 frangibly is connected about the second open end 16 of the end cap 12 by a plurality of severable strap members 22. Preferably, eight straps 22 are utilized, one each positioned in predetermined locations about the periphery of the closure 10. It is to be understood that the number of straps 22 as well as the particular frangible connection between the tamper band 20 and end cap 12 can vary.

Briefly, as FIG. 4 illustrates, the closure 10 is utilized to threadingly engage a neck portion 24 of a container 26 and to seal the mouth (not illustrated) of the container 26 against leakage of material contained therein. To enable severing of the strap members 22 and removal of the end cap 12, a flexible engagement portion or flange 28 integrally is formed with the tamper band 20 to grip a substantially cylindrical or rectilinear portion 30 of the neck 24 during mounting and removal of the closure 10 from the container 26. The engagement portion 28 restricts the tamper band 20 from axial movement to enable severing of the straps 22 and keeps the tamper band 20 on the container neck 24 after severing of the straps 22 and removal of the end cap 12, without any flange on the neck portion 24, to provide evidence of tampering with the container 26 and/or closure 10.

Preferably, the closure 10 and container 26 are formed from plastic, but the particular material, size and shape of the closure 10 and container 26 can vary. Additionally, although the closure 10 is depicted as being threadingly engaged with the container 26, it is to be understood that the particular engagement between the closure 10 and container 26 also can vary so long as the closure 10 functions as described herein.

To provide the preferred threading engagement, an exterior surface of the neck 24 of the container 26 includes a plurality of threads 32. The threads 32 are designed for complementary threading engagement with threads 34 formed on an interior surface 36 of the side wall 18 of the end cap 120.

FIG. 3 illustrates the general shape of the closure 10 before being assembled to the container 26. The tamper band 20 is connected to the second open end 16 of the end cap 12 by the severable straps 22, only one of which is illustrated. The flexible engagement portion or flange 28 substantially is annular in shape and includes a first proximal end 36, integrally formed with a bottom surface 38 of the tamper band 20, and a second distal end 40, extending downwardly away from the tamper band 20 at a slight angle toward the interior of the end cap 12, which is to the left with respect to FIG. 3.

To enhance the flexibility of the engagement portion 28, the first proximal end 36 preferably is formed with relieved annular portions 42, one each on either side of the engagement portion 28. The relieved portions 42 thus provide somewhat of a hinge action to the first proximal end 36 of the engagement portion 28.

As FIG. 4 illustrates, during fitting or mounting of the closure 10 onto the neck 24 of the container 26, the engagement portion 28 of the tamper band 22 is flexed upward by the container mouth and neck portion 24 and rotates about the first proximal end 36 toward the tamper band 22 to the position illustrated. When the closure 10 is completely mounted to the container 26, an outside edge 44 of the distal end 40 of the engagement portion 28 engages the cylindrical rectilinear portion 30 of the neck 24 and provides engagement along a line or "line contact" as opposed to contact over a surface area.

To strengthen the tamper band 22 and enhance gripping of the neck 24, an inside surface 46 of the tamper band 22 includes a plurality of ribs 48 formed therewith. Preferably, eight ribs 48 are utilized, one each at a predetermined position about the inside surface 46 but the number, shape and positioning of the ribs 48 can vary. The ribs 48 substantially extend across the width of the tamper band 22 and include an engagement corner 50 which contacts a portion of the engagement portion 28 proximate the first proximal end 36. The ribs 48 therefore limit the upward or inward flexing of the engagement portion 28 which in turn increases the resilient and compressive forces exerted on the neck 24.

Figure 7:
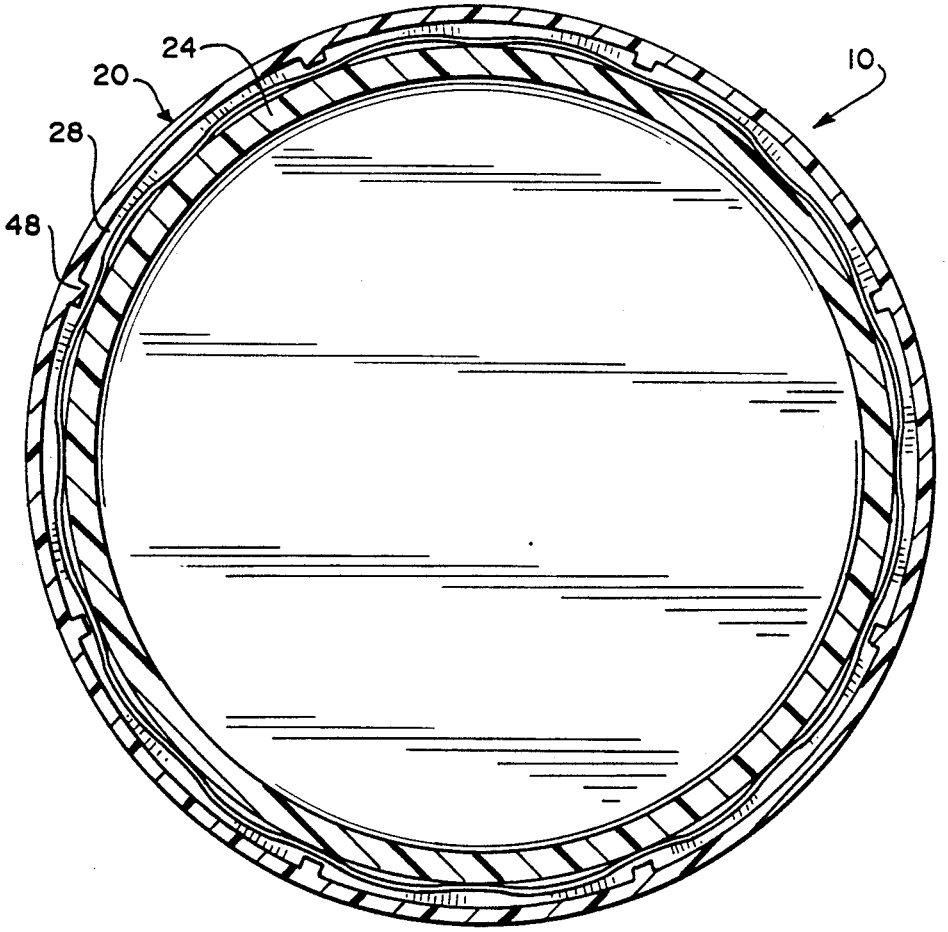
FIG. 7 is a horizontal cross-sectional view of the closure of the invention taken along line 7—7 of FIG. 6 and in the direction indicated generally illustrating the flexible contact of the engagement member with the container neck.

Additionally, since the ribs 48 are positioned at intervals about the tamper band 22, the engagement portion 28 is provided with a wave-like, serpentine or pleated shape as FIG. 7 illustrates. This wave-like configuration strengthens the tamper band 22 and engagement portion 28, provides increased engagement proximate the ribs 48 and assists in filling in the area between the closure 10 and the container 26. If desired, the engagement portion 28 can be pre-formed with the wave-like or serpentine shape rather than having the ribs 48 provide such a shape.

Figure 6:
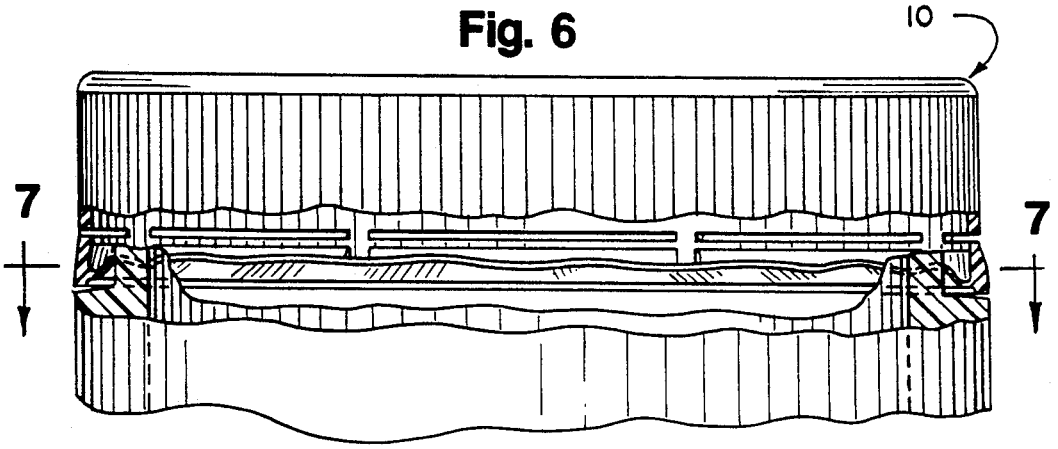
FIG. 6 is a front elevational view in partial section of the closure of the invention attached to a container neck illustrating the flexible contact between the engagement member of the tamper band with the cylindrical or rectilinear neck portion of the container.

To install the closure 10 to the neck 24 of the container 26, the closure 10 is provided as illustrated in FIGS. 1 and 3 with the engagement portion 28 of the tamper band 22 extending downward or outward. The closure 10 then axially is aligned with the open mouth of the container 26 and forced downward thereon, with or without twisting or screwing of the closure 10, until the closure 10 is seated on the neck 24 in the position illustrated in FIGS. 4 and 6.

In that position, the outer edge 44 of the distal end 40 of the engagement portion 28 is seated against the rectilinear portion 30 of the neck 24 and provides the desired gripping, assisted by the ribs 48. Thereafter, the end cap 12 is unscrewed while the tamper band 22 remains axially and/or rotationally secured to the rectilinear portion 30 thereby severing the straps 22 as the end cap 12 moves axially away due to the action of the screw threads 32 and 34. The end cap 12 then can be removed from the container 26 with the tamper band 20 remaining about the neck 24 to provide evidence of tampering.

As FIG. 5 illustrates, to assist in installing the closure 10 to the container 26 during screwing thereon, the engagement portion 28 can include thread portions 51 formed thereabout. The thread portions 51 are positioned at intervals about the engagement portion 28 and approximate the dimensions of the container threads 32 for alignment therewith.

It is to be noted that the engagement portion 28 and ribs 48 provide sufficient gripping of the rectilinear portion 30 after being assembled to the container 26 to enable the desired severing of the straps 22 without the need for any additional flange On the neck 24. To assist in gripping, if desired, the rectilinear portion 30 of the neck 24 can be tapered slightly outward toward the open mouth of the container (not illustrated).

Additionally, it has been determined that after the closure 10 is affixed about the neck 24 for a period of time, the plastic tends to set, especially with regard to the engagement portion 28 which is in significant compression with respect to the neck 24. This "setting" of the plastic can reduce the gripping power of the engagement portion 28, especially if the container 26 is stored for long periods of time.

Accordingly, as FIG. 5 illustrates, in order to enhance the compressive force to the engagement portion 28 during removal of the end cap 12 after long periods of storage, the neck 24 can be formed to include an annular bead 52 thereabout. The bead 52 substantially is rounded and does not provide a discrete surface against which the engagement portion 28 axially would abut to provide any severing of the straps 22. The bead 52, rather, provides a slight outward deflection of the engagement portion 28 toward the tamper band 20. The slight outward deflection in turn enhances the gripping power of the engagement portion 28 against the rounded surface of the bead 52 since the engagement portion 28 is further leveraged between the bead 52 and the ribs 48.

Modifications and variations of the present invention are possible in light of the above teachings. A specific dimension, material or construction is not required so long as the assembled closure functions as herein described. It therefore is to be understood that within the scope of the appended claims, the invention may be practiced otherwise than as specifically described.

What is claimed and desired to be secured by letters patent is:

1. A tamper evident closure for a container opening, comprising:

a substantially cylindrical end cap closed at a first end by a top surface, open at a second opposite end and including an annular side wall having a predetermined width extending between said first and second ends;

tamper band means frangibly connected about said second opposite end of said end cap for detaching from said end cap and remaining affixed to the container upon removal of said end cap from the container;

an annular band integrally formed with a first portion of an inside surface of said tamper band means with a substantially serpentine shape for providing gripping contact between said tamper band means and a substantially cylindrical neck portion of the container, for restricting axial movement of said tamper band means with respect to said end cap and said neck portion and for preventing removal of said tamper band means from said container upon severing of said frangible connection and removal of said end cap; and stop means integrally formed with a second portion of, and at a plurality of predetermined positions about, said inside surface of sad tamper band means for reinforcing said annular band during gripping contact with said cylindrical neck portion of the container.

2. The closure as defined in claim 1 wherein said stop means include rib means formed on an interior surface of said tamper band means for reinforcing said annular band and preventing removal of said tamper band means.

3. The closure as defined in claim 1 wherein said stop means include rib means formed on an interior surface of said tamper band means for reinforcing said annular band and providing said substantially serpentine shape to said annular band to effect contract between said annular band and said cylindrical neck portion of said container proximate a position of each of said rib means.

4. The closure as defined in claim 1 wherein said annular band is pre-formed to provide said substantially serpentine shape.

5. The closure as defined in claim 1 wherein said annular band is relieved proximate the connection with said tamper band means.

6. The closure as defined in claim 1 wherein said annular band includes a discrete edge for providing line contact between said annular band and said cylindrical neck portion of said container.

7. The closure as defined in claim 1 wherein said annular band includes thread means for assisting in installing said annular band to a container neck.

8. A tamper evident closure for a container opening, comprising:

a substantially cylindrical end cap closed at a first end by a top surface, open at a second opposite end and including an annular side wall having a predetermined width extending between said first and second ends;

tamper band means frangibly connected about said second opposite end of said end cap for detaching from said end cap and remaining affixed to the container upon removal of said end cap from the container;

an annular band integrally formed with a first portion of an inside surface of said tamper band means with a performed substantially serpentine shape for providing gripping contact between said tamper band means and a substantially cylindrical neck portion of the container, for restricting axial movement of said tamper band means with respect to said end cap and said neck portion and for preventing removal of said tamper band means from said container upon severing of said frangible connection and removal of said end cap; and stop means integrally formed with a second portion of, and at a plurality of predetermined positions about, said inside surface of said tamper band means for reinforcing said annular band during gripping contact with said cylindrical neck portion of the container, said stop means including rib means formed on an interior surface of said tamper band means for reinforcing said annular band and assisting in providing said substantially serpentine shape to said annular band to effect contact between said annular band and said cylindrical neck portion of said container proximate a position of each of said rib means.

* * * * *